US006070923A

United States Patent [19]

Tanimoto et al.

[11] Patent Number: 6,070,923

[45] Date of Patent: Jun. 6, 2000

[54] OUTSIDE DOOR HANDLE ASSEMBLY FOR AUTOMOTIVE VEHICLES

[75] Inventors: Tetsurou Tanimoto, Anjyo; Morihito Nomura, Toyoake; Kouji Ooe, Nagoya; Kouichi Nagata, Ohbu, all of Japan

[73] Assignee: Aisin Seiki Kabushiki Kaisha, Japan

[21] Appl. No.: 08/757,567

[22] Filed: Nov. 27, 1996

[30] Foreign Application Priority Data

Nov. 28, 1995 [JP] Japan ..... 7-331204

[51] Int. Cl.[7] ..... E05B 3/00

[52] U.S. Cl. ..... 292/336.3; 292/DIG. 22; 292/DIG. 65; 292/DIG. 41

[58] Field of Search ..... 292/336.3, DIG. 22, 292/DIG. 41, DIG. 65, 347

[56] References Cited

U.S. PATENT DOCUMENTS

| | | | |
|---|---|---|---|
| 2,864,641 | 12/1958 | Leslie . | |
| 3,719,248 | 3/1973 | Breitschwerdt et al. | 180/112 |
| 4,382,622 | 5/1983 | Ishikawa | 292/DIG. 65 |
| 4,714,282 | 12/1987 | Henderson | 292/DIG. 65 |
| 4,892,342 | 1/1990 | Newman et al. | 292/347 |
| 4,995,654 | 2/1991 | Nishigami et al. | 292/DIG. 65 |
| 5,069,493 | 12/1991 | Mochida et al. | 292/DIG. 65 |
| 5,284,373 | 2/1994 | Watson | 292/347 |
| 5,584,516 | 12/1996 | Cetnar | 292/DIG. 65 |
| 5,669,642 | 9/1997 | Kang | 292/DIG. 65 |

FOREIGN PATENT DOCUMENTS

| | | |
|---|---|---|
| 2 003 342 | 11/1969 | France . |
| 3402914 | 8/1985 | Germany . |
| 46-7048 | 2/1971 | Japan . |
| 2-40864 | 3/1990 | Japan . |

OTHER PUBLICATIONS

Official Letter dated Nov. 14, 1997 (1 page) and English translation (8 pages).

*Primary Examiner*—Darnell M. Boucher
*Attorney, Agent, or Firm*—Finnegan, Henderson, Farabow, Garrett & Dunner, L.L.P.

[57] ABSTRACT

An outside door handle assembly for an automobile includes a handle lever that follows the motion of an outside handle. When a transverse load in excess of a predetermined value acts upon the vehicle as the result of an impact at the side thereof, the handle lever is caused to swing in the transverse direction outwardly of the vehicle against the biasing force of a spring. As a result, an opening lever in a door lock device is placed in an inoperative state so that the door will not open accidentally during a side collision.

8 Claims, 10 Drawing Sheets

OUTSIDE DOOR HANDLE ASSEMBLY FOR AUTOMOTIVE VEHICLES

BACKGROUND OF THE INVENTION

This invention relates to an outside door handle for vehicles contrived to deal with application of transverse load.

The door handle for opening and closing the door of an automotive vehicle functions as a handle for opening and closing the door and as means for manipulating a door lock device via a link mechanism. An example of such a door handle is disclosed in the specification of Japanese Utility Model Laid-Open Publication No. 2-40864. This specification discloses a vehicular outside door handle having a handle case (bezel) secured to a stationary member on the door side, a pair of spaced frames formed as an integral part of the handle case, a shaft extending between the frames, an outside handle freely rotatably supported on the shaft via the pair of arms, and a handle lever freely rotatably supported on one of the arms and operatively associated with an opening lever of a door lock device. By pulling the outside handle, the opening lever is operated using the handle lever, thereby placing the door lock device in the unlatched state so that the door can be opened. (The "unlatched state" refers to a state in which a latch and pawl are disengaged from each other to enable a striker to be freely withdrawn from and inserted into the latch.)

Such an outside door handle assembly for an automotive vehicle is engineered and fabricated upon taking into account at least the strength needed to withstand the load necessary to release the door lock, the strength to assure reliability with regard to withstanding repeated use, and the strength to withstand excessive operating force and impact.

The higher performance of modern automotive vehicles has been accompanied by the need to develop an outside door handle capable of withstanding higher impact force sustained at the time of a vehicular impact.

SUMMARY OF THE INVENTION

Accordingly, an object of the present invention is to provide a vehicular outside door handle assembly capable of withstanding high impact in the transverse direction at the time of collision sustained at the side of the vehicle.

According to the present invention, the foregoing object is attained by providing an outside door handle for an automotive vehicle comprising a handle case secured to a door of an automotive vehicle, an outside handle freely rotatably supported on the handle case and linked to an opening lever of a door lock device which holds the door closed, the door being opened by turning the opening lever through rotation of the outside handle, and a handle lever freely rotatably supported on the outside handle for being swung transversely outwardly of the vehicle in response to being acted upon by a transverse load in the transverse direction of the vehicle, wherein rotation of the opening lever by rotation of the outside handle is limited by transverse swinging of the handle outwardly of the vehicle lever owing to an applied transverse load.

In another embodiment of the invention, the foregoing object is attained by providing an outside door handle for an automotive vehicle comprising a handle case secured to a door of an automotive vehicle, an outside handle freely rotatably supported on the handle case and linked to an opening lever of a door lock device which holds the door closed, the door being opened by turning the opening lever through rotation of the outside handle, a pair of spaced frames formed on the handle case, a shaft extending between the frames, a pair of arms, formed on the outside handle and freely rotatably supported on the shaft, a handle lever freely swingably supported on one of the arms and capable of swinging in one direction in response to being acted upon by a transverse load in the transverse direction of the vehicle, a spring provided between the one arm and the handle lever for swingingly biasing the arm in the other direction, a rod connecting the other arm to the opening lever, and a stopper secured to the handle case for engaging the handle lever owing to swinging of the handle lever in the one direction.

The invention further provides an outside door handle for an automotive vehicle comprising a handle case secured to a door of an automotive vehicle, an outside handle freely rotatably supported on the handle case and linked to an opening lever of a door lock device which holds the door closed, the door being opened by turning the opening lever through rotation of the outside handle, a pair of spaced frames formed on the handle case, a shaft extending between the frames, a pair of arms formed on the outside handle and freely rotatably supported on the shaft, a handle lever freely swingably supported on one of the arms and engageable with the opening lever along a path of engagement for being swung in one direction, in response to being acted upon by a transverse load in the transverse direction of the vehicle, so as to leave the path of engagement with the opening lever, and a spring provided between the one arm and the handle lever for swingingly biasing the arm in the other direction.

By selecting the magnitude of the biasing force of the spring which biases the handle lever that swings transversely of the vehicle in response to application of a transverse load, it is possible to set a minimum transverse load that is capable of placing the opening lever of the door lock device in an inoperative state. The outside door handle of the present invention can be fabricated so as to be light in weight. Moreover, since the handle lever is capable of swinging independently of the arms of the outside handle, motion of the handle lever at application of transverse load is checked using the stopper face of the handle case, thereby impeding turning of the arms. This places the opening lever in the inoperative state through the rod connected to one of the arms, thus making it possible to place the door in the latched state. The assembly in simple in structure and performs the expected operation in reliable fashion.

Furthermore, after the handle lever is displaced from the operating path of the opening lever of the door lock device and then moved to the side of the handle lever, the handle lever is capable of assuming a freely swinging state with respect to the opening lever. At application of a transverse load, therefore, the door lock device can be positively maintained in the latched state.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS

Preferred embodiments of the present invention will now be described in detail with reference to the accompanying drawings.

Figure 1:
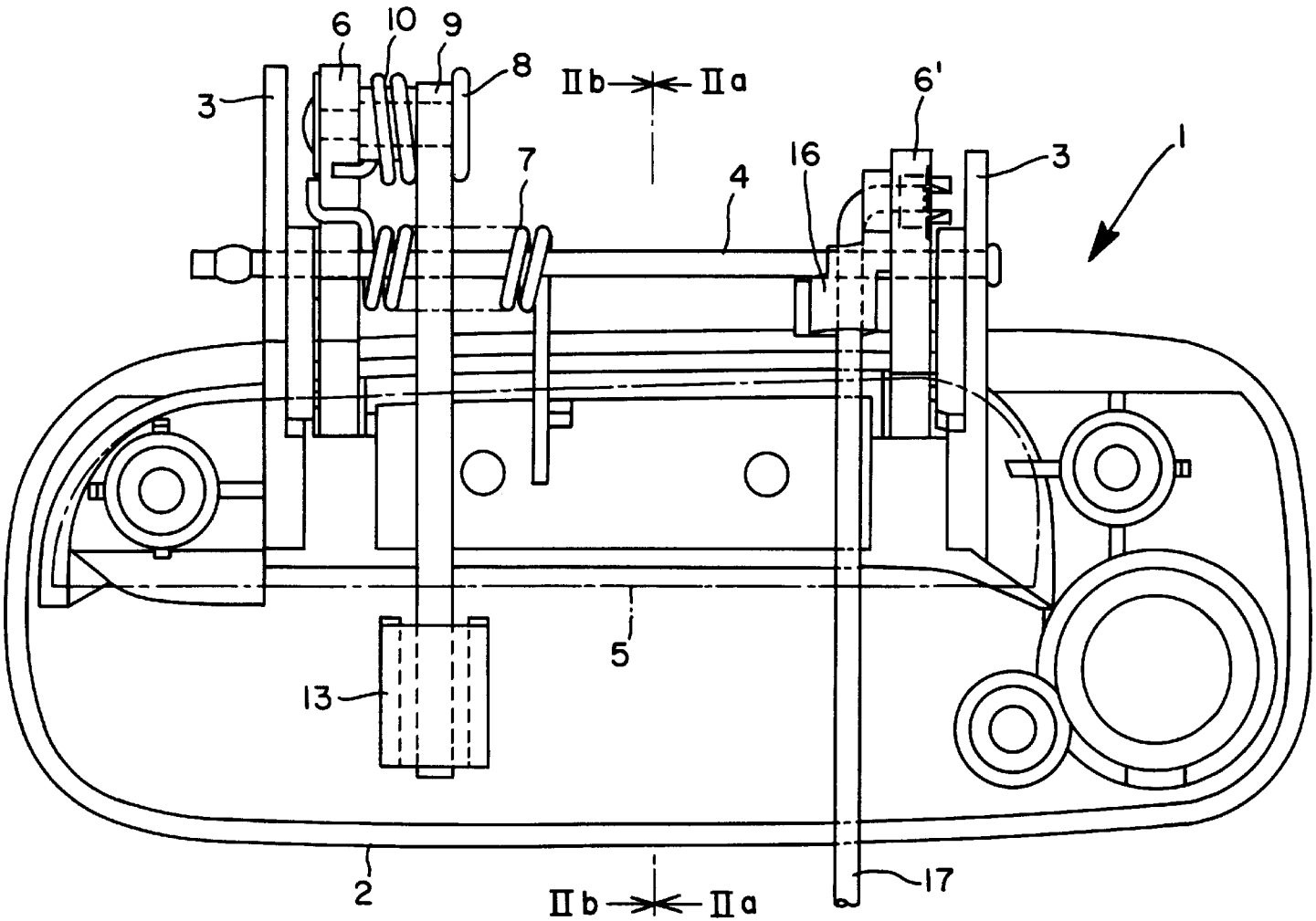
FIG. 1 is a view of the back side of an outside door handle assembly of an automotive vehicle in accordance with a first embodiment of the present invention.

An outside door handle assembly 1 according to a first embodiment of the invention is illustrated in FIGS. 1 through 5. The door handle assembly 1 has a handle case (bezel) 2 secured to a stationary member of a vehicle door. The handle case 2 is integrally formed to include a pair of spaced frames 3. A shaft 4 extends across the pair of frames 3. FIG. 1 illustrates the back face of the handle case 2. A pair of arms 6, 6' of an outside handle 5 disposed on the front surface of the handle case are freely rotatably supported on the shaft 4. A spring 7 is disposed between one arm 6 and the handle case 2 and biases the outside handle 5 toward the position shown in FIG. 2, namely, the spring 7 urges clockwise the outside handle 5. When the outside handle 5 is pulled to the right in FIG. 2, the outside handle 5 turns about the shaft 4 against the biasing force of the spring 7 (see FIG. 4).

The back surface of the handle case 2 is integrally formed to have a bifurcated stopper 13. The lower portion of a handle lever 9 is situated between the opposing bifurcations of the stopper 13. The root portion of the stopper 13 has a flat stopper surface 14.

Figure 2:
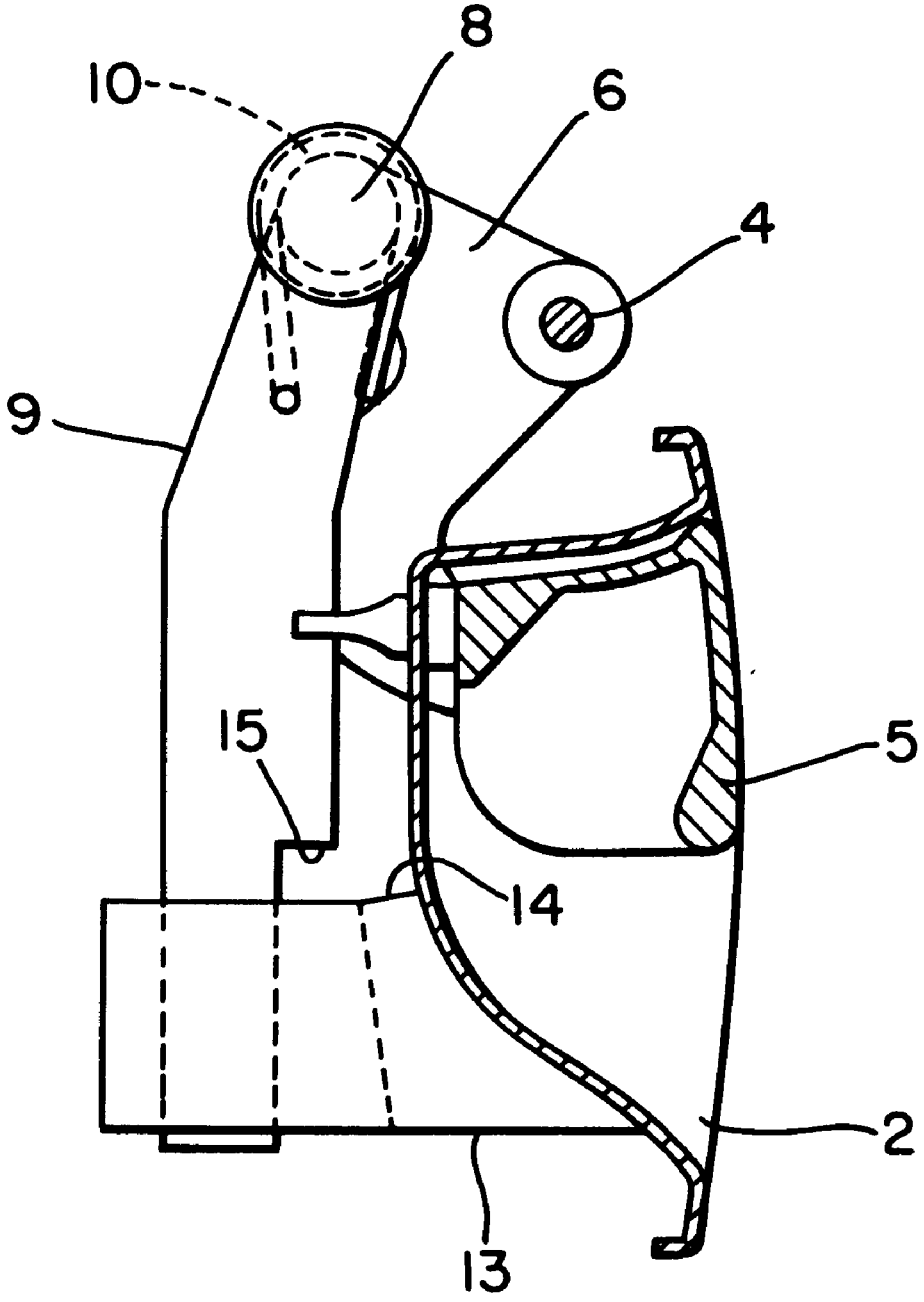
FIG. 2 is a sectional view as seen from line IIa—IIa of FIG. 1.

The handle lever 9 is supported on the one arm 6 via a spring 10 and a pin 8 and is maintained at all times in the position, relative to the handle case 2, shown in FIG. 2. The handle lever 9 has a step-shaped hook surface 15 provided on its lower portion.

The other arm 6' engages an upper end of a vertically extending rod 17 via a snap 16. The rod 17 is connected to a door lock device 19 via an opening lever 18. More specifically, when the outside handle 5 is turned counter-clockwise about the shaft 4 in FIG. 3, the rod 17 is pushed down by the arm 6', which is an integral part of the outside handle 5, thereby operating the door lock device 19 via the opening lever 18. At this time the handle lever 9 is pushed down via the arm 6, which is an integral part of the outside handle 5, and the spring 10 in a manner described later, whereby the handle lever 9 assumes the position shown by the phantom lines in FIG. 4.

Figure 4:
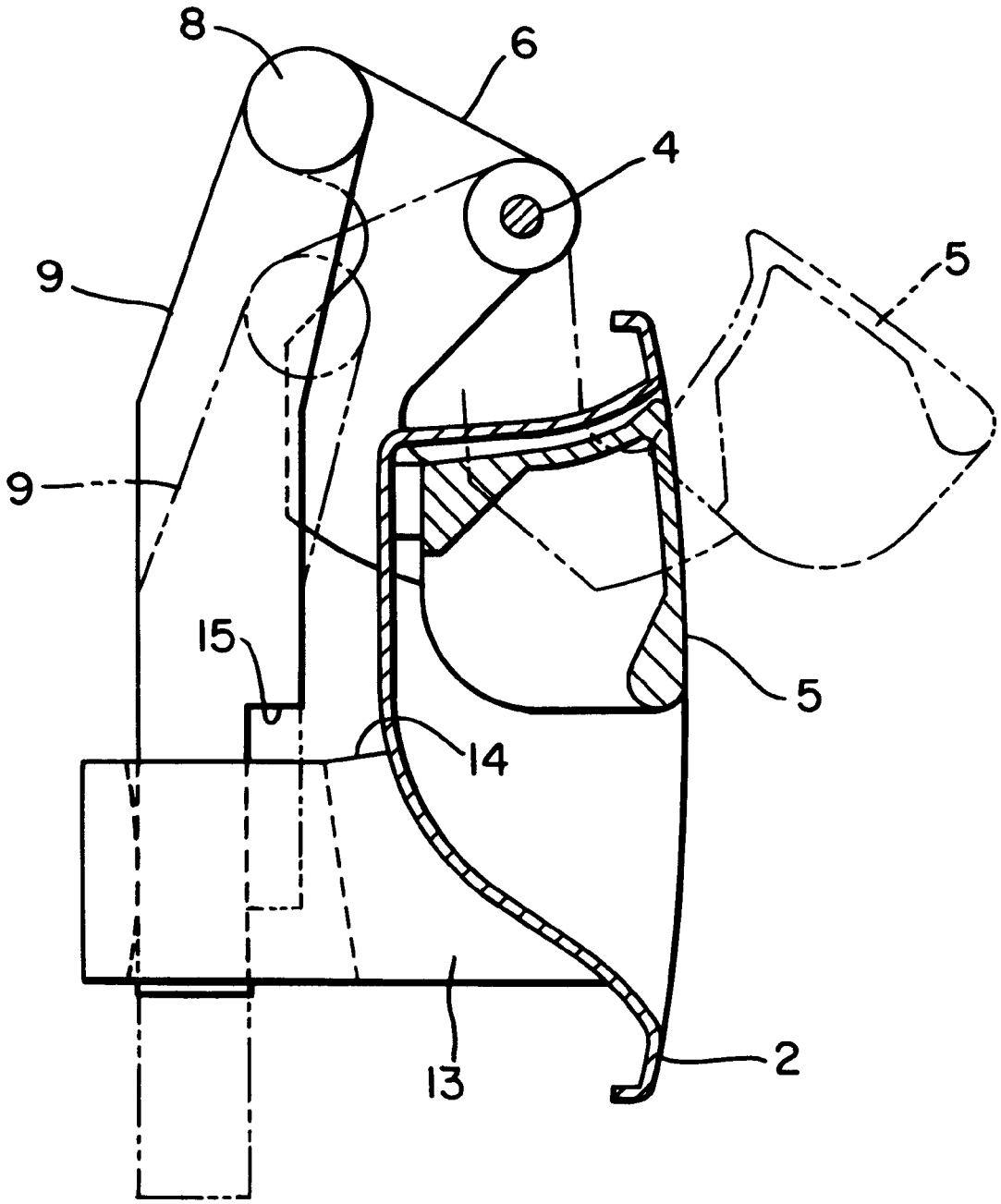
FIG. 4 is a sectional view illustrating an outside handle being pulled in an ordinary manner.
Figure 5:
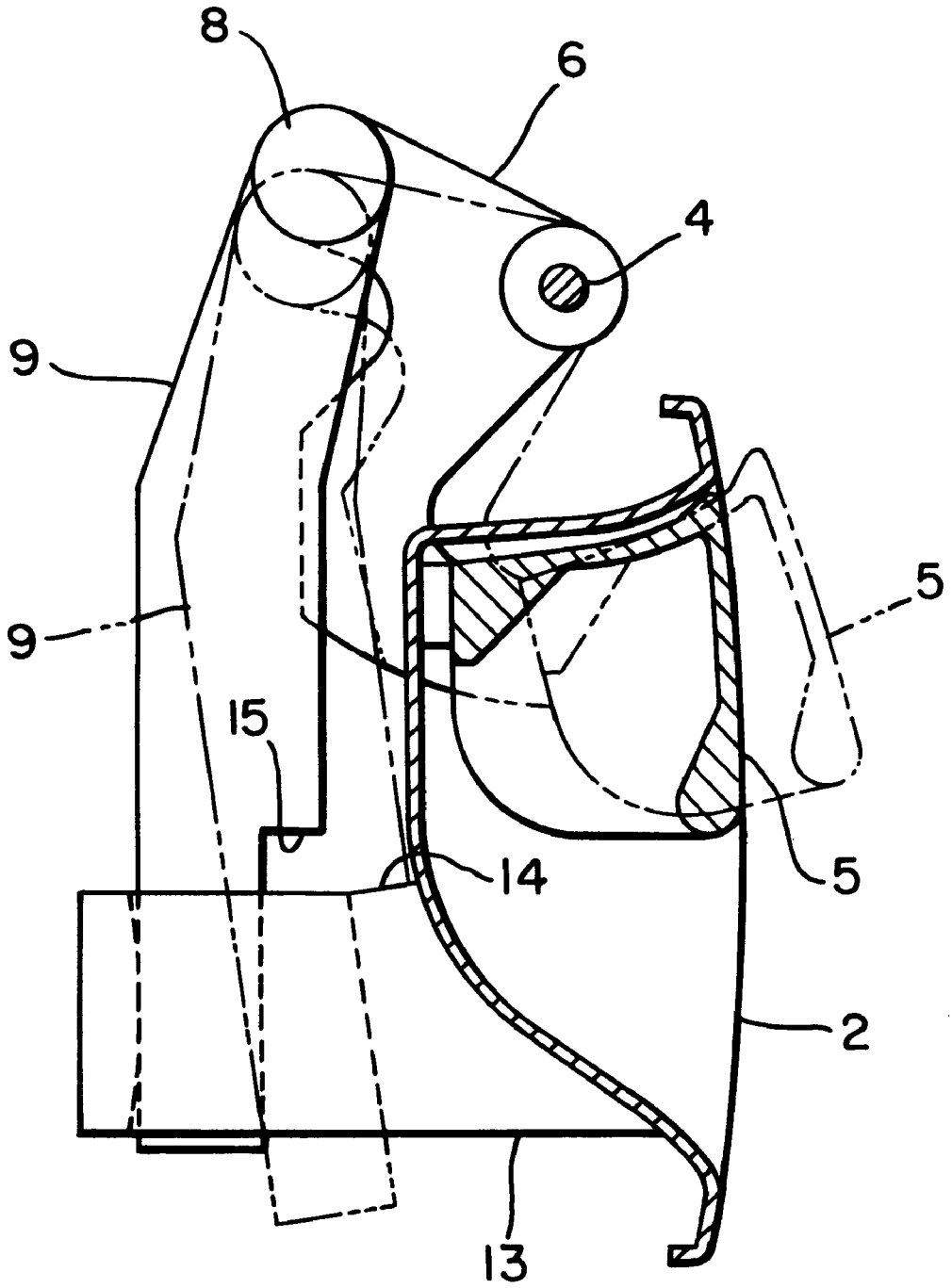
FIG. 5 is a sectional view illustrating the outside handle being pulled out forcibly in response to application of a transverse load.

When the outside handle 5 is pulled from the position of FIG. 2 in the manner illustrated in FIG. 4, the handle lever 9 is pushed down while the arm 6 integral with the handle 5 turns counter-clockwise about the shaft 4. The hook face 15 of the handle lever 9 moves up and down between the bifurcations of the stopper 13 and does not contact the stopper face 14. In other words, the usual door opening operation is achieved in the manner indicated by the phantom lines in FIG. 4.

Figure 3:
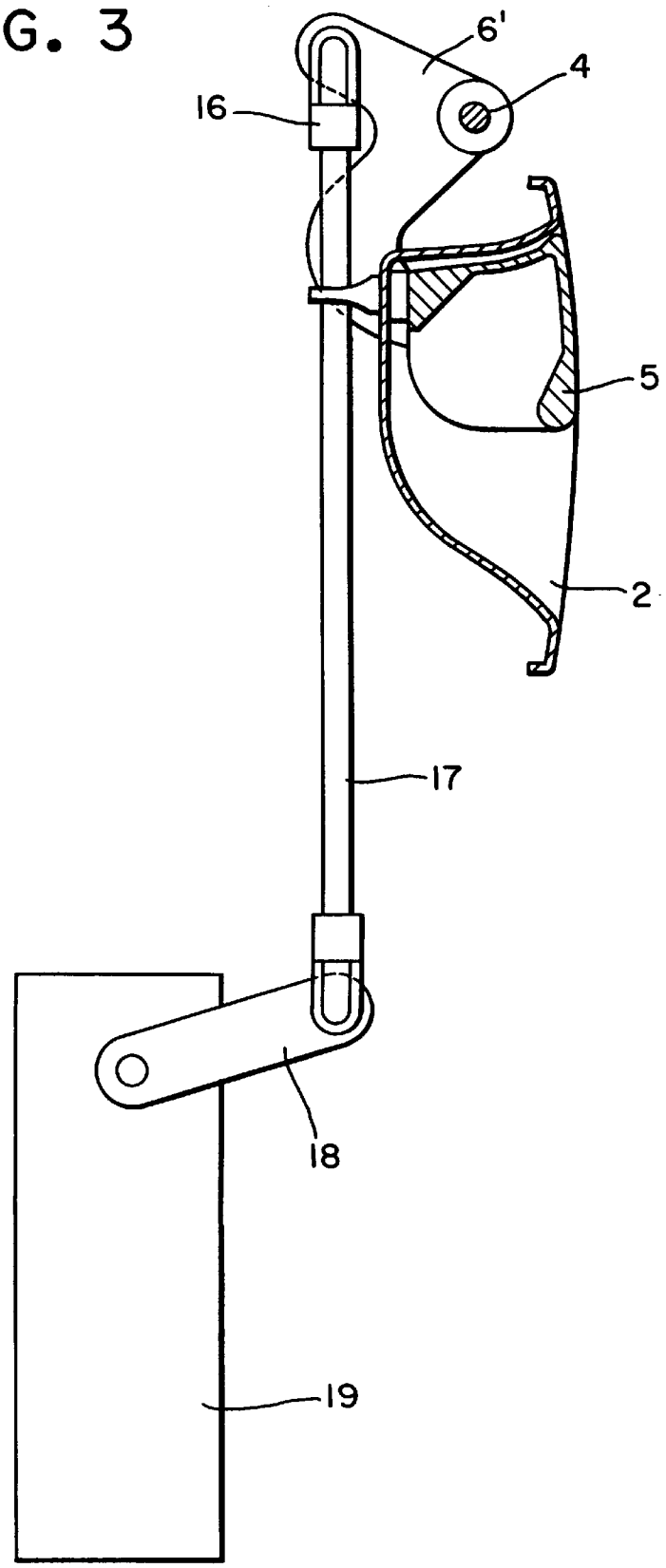
FIG. 3 is a sectional view as seen from line IIb—IIb of FIG. 1.

More specifically, when the outside handle 5 is pulled against the biasing force of the spring 7 and is moved to the position indicated by the phantom lines in FIG. 4 so that the pair of arms 6, 6' are turned counter-clockwise in FIGS. 2 and 3 about the shaft 4, the rod 17 connected to the arm 6' is pushed down, as shown in FIG. 3, whereby the opening lever 18 of the door lock device 19 is turned. As a result, the door lock device 19 assumed the unlatched state and the door opens. At this time the handle lever 9 is acted upon by the biasing force of the spring 10 and is swingingly biased in the clockwise direction in FIG. 2 so that the hook face 15 of the handle lever 9 and the stopper face 14 of the stopper 13 no longer oppose each other. Accordingly, the handle lever 9 is merely moved up and down by the turning of arm 6 and the above-described turning of the pair of arms 6, 6' is not regulated.

When a transverse load in excess of a predetermined value decided by the biasing force of the spring 7 is applied, the outside handle 5 is pulled out of the handle case 2 (to the position indicated by the phantom lines in FIG. 5) during traveling of the vehicle. Though this motion of the outside handle 5 is accompanied by motion of the handle lever 9 owing to the intermediary of the arm 6, the rightward motion of the handle lever 9 in FIG. 5 causes the hook face 15 of the handle lever 9 to abut against the opposing stopper face 14 so that any further outward movement of the outside handle 5 and any further downward movement of the handle lever 9 is limited, regardless of the forcible rightward movement of the outside handle 5 owing to transverse load. Consequently, turning of the arms 6, 6' is checked and there is no downward movement of the rod 17. As a result, the above-mentioned turning of the arms 6, 6' (namely when the door is to be opened) and the above-mentioned movement of the outside handle 5 (namely when the door is to be opened) are checked. Accordingly, the opening lever 18 of the door lock device 19 will not turn (i.e., its turning motion is checked) and the door locking device 19 will be held in the latched state. In other words, the door is kept closed.

Figure 6:
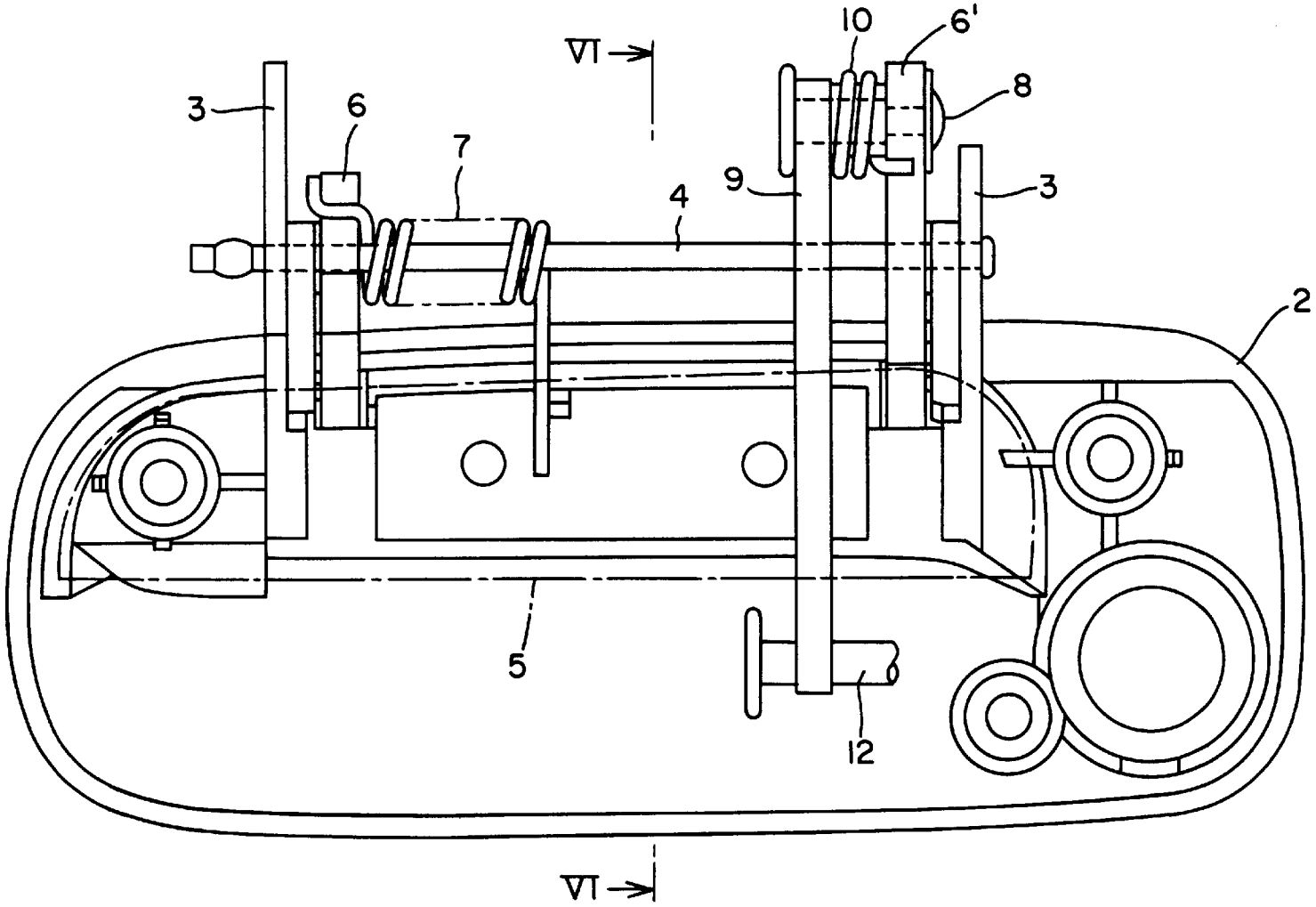
FIG. 6 is a partial back view of an outside door handle assembly according to a second embodiment of the invention.

A second embodiment of an outside door handle assembly according to the present invention is illustrated in FIGS. 6 through 9. The door handle assembly 1 has the handle case (bezel) 2 secured to a stationary member of a vehicle door and integrally formed to include the pair of spaced frames 3. The shaft 4 extends across the pair of frames 3. FIG. 6 illustrates the back face of the handle case 2. A pair of arms 6, 6' of the outside handle 5 disposed on the front surface of the handle case 2 are freely rotatably supported on the shaft 4. The spring 7 is disposed between one arm 6 and the handle case 2 and biases the outside handle 5 toward the position shown in FIG. 7, namely, the spring 7 biases clockwise the outside handle 5. When the outside handle 5 is pulled to the right in FIG. 7, the outside handle 5 turns about the shaft 4 against the biasing force of the spring 7 (see FIG. 8).

The other arm 6', which is an integral part of the outside handle 5, is longer than the first arm 6. The handle lever 9 is suspended from the arm 6' via the spring 10 and the pin 8. The spring 10, which has one end engaged with the arm 6' and its other end engaged with the handle lever 9 by inserting it into the hole formed on the handle lever, holds the handle lever 9 at the position indicated by the solid lines in FIG. 7.

Figure 7:
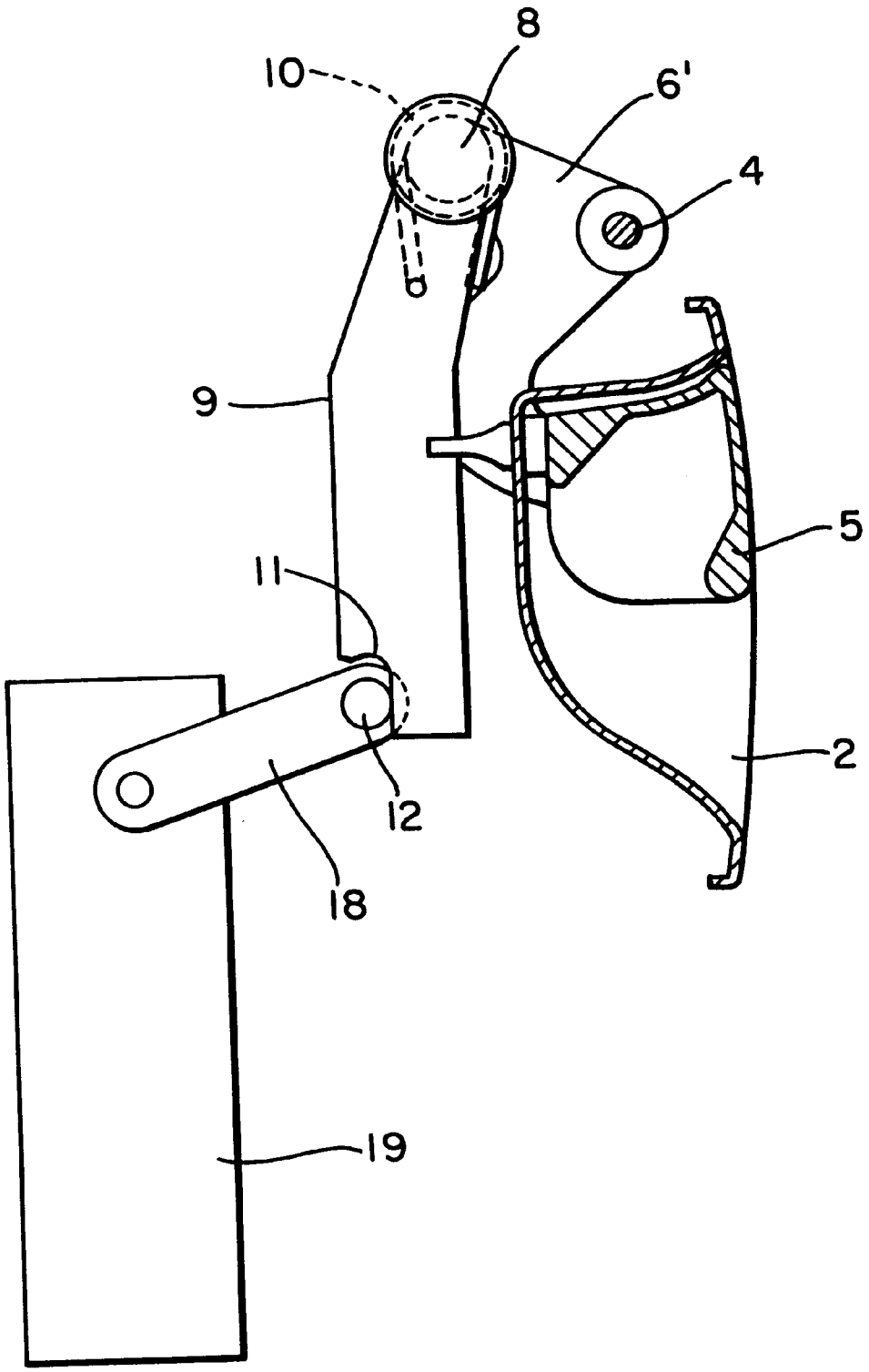
FIG. 7 is a sectional view as seen from line VI—VI of FIG. 6.

The handle lever 9 is formed to include a step portion 11 on the left side of its lower end (as seen in FIG. 7). The step portion 11 opposes a pin 12 located at the distal end of the opening lever 18 of the door lock device 19.

Figure 8:
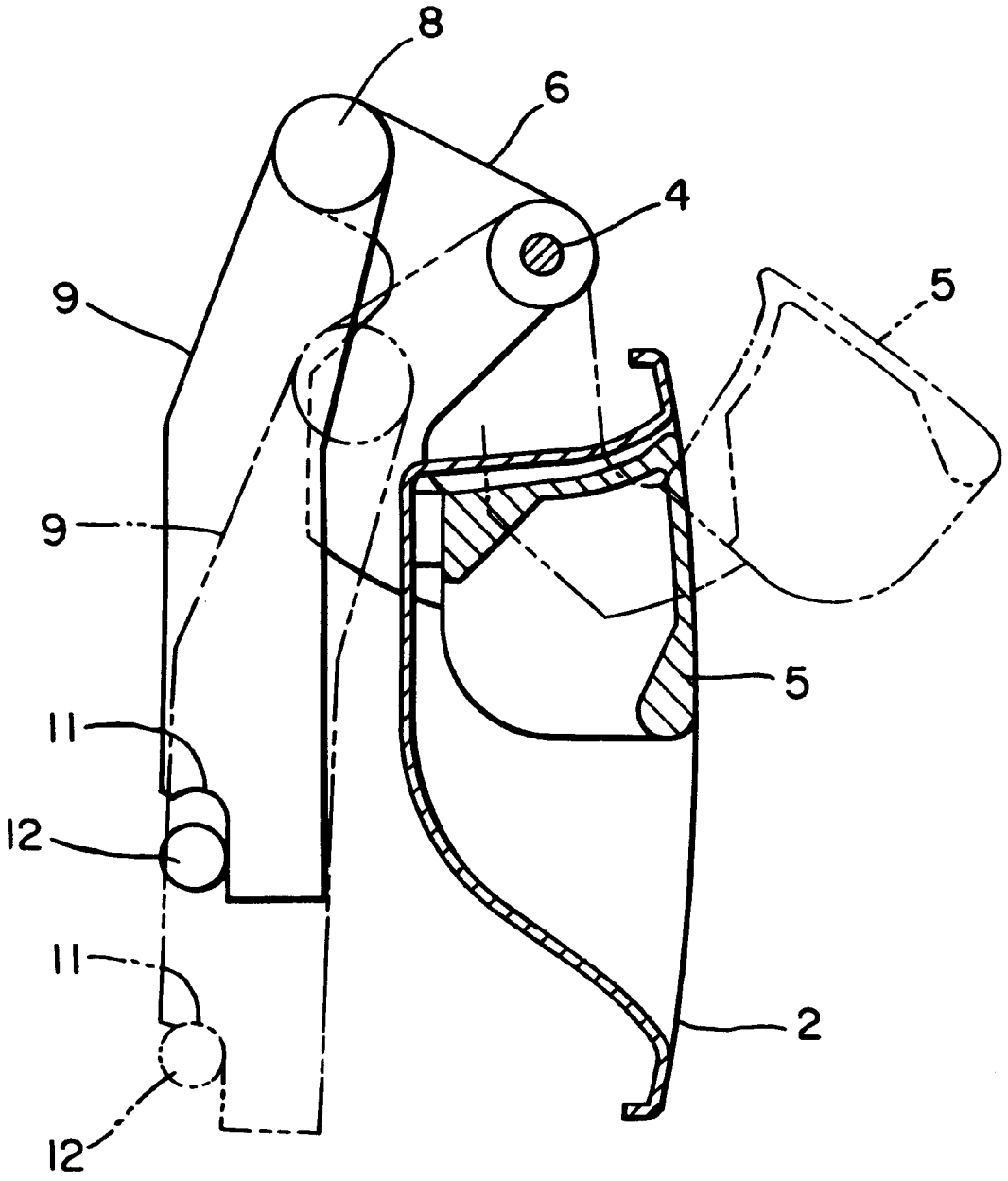
FIG. 8 is a sectional view illustrating an outside handle being pulled in an ordinary manner.

In order to open the door in the ordinary manner, the outside handle 5 is pulled to the position indicated by the phantom lines in FIG. 8. When this done, the pair of arms 6, 6' turn about the shaft 4 so that the pin 8 is turned counter-clockwise about the shaft 4, thereby lowering the handle lever 9 to the position indicated by the phantom lines in FIG. 8 (the handle lever 9 is not swung to the side owing to the spring 10) so that the pin 12 is pushed down by the step portion 11. This operates the opening lever 18 so that the door lock is placed in the unlatched state. The door opens as a result.

Figure 9:
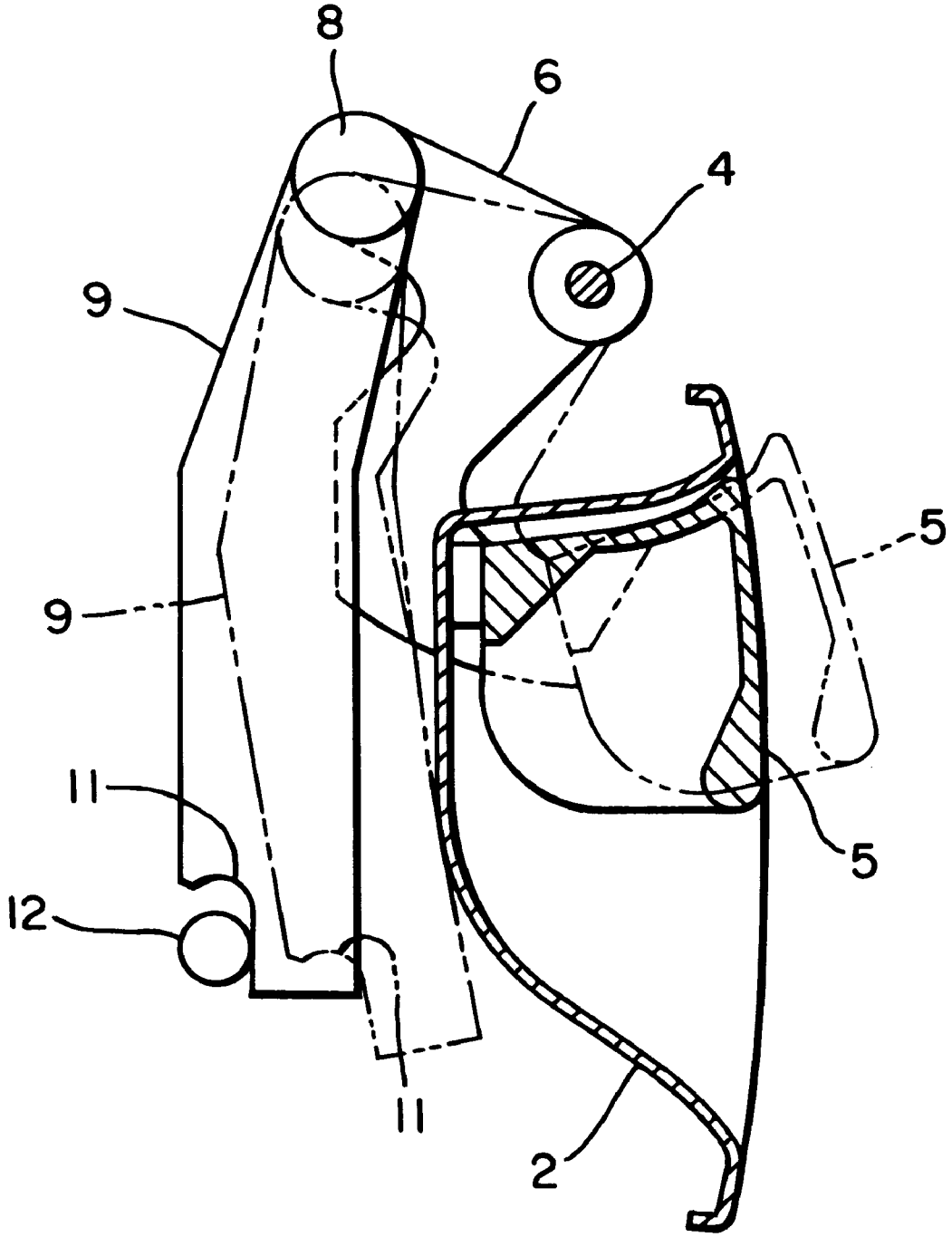
FIG. 9 is a sectional view illustrating the outside handle being pulled out forcibly in response to application of a transverse load.

When the traveling vehicle sustains a transverse load as caused by a collision on one side of the vehicle, the outside handle 5 and handle lever 9 move to the right in FIG. 9 (i.e., in the direction of the door handle) against the biasing force of the springs 7 and 10 so the outside handle 5 and handle lever 9 assume the positions indicated by the phantom lines in FIG. 9. The biasing force of the spring 7 decides the magnitude of the transverse load that will cause the outside handle 5 and handle lever 9 to be moved to the positions indicated by the phantom lines.

The motion of the handle lever 9 under the application of the transverse load causes the handle lever 9 to abut against the back face of the handle case 2, whereupon the handle lever 9 comes to rest. However, the step portion 11 and pin 12 are now no longer in an opposing relationship. Accordingly, even if the outside handle 5 is moved further in the handle direction against the biasing force of the spring 7 to push down the handle lever 9, the opening lever 18 will not be actuated and the door lock device 19 will remain in the latched state.

In other words, when a transverse load acts upon the vehicle as the result of a collision or the like, the outside handle 5 attempts to move in the manner described above (i.e., so as to the open the door). That is, the arms 6, 6' attempt to turn (so as to open the door). At this time the handle lever 9 also swings counter-clockwise in FIG. 8 relative to the arm 6 against the biasing force of the spring 10 owing to the application of the transverse load, whereby the step portion 11 of the handle lever 9 is displaced from its path of engagement with the pin 12, as indicated by the phantom lines in FIG. 9. As a result, the handle lever 9 assumes a freely swinging state relative to the pin 12, the opening lever 18 of the door lock device 19 has its rotation prevented and therefore does not turn in the manner described above (i.e., so as to open the door), and the door lock device 19 is kept in the latched state. That is, the door is held closed. The second embodiment differs from the first embodiment in that the above-mentioned movement of the outside handle 5 (when the door is to be opened), the above-described turning of the arms 6, 6' (when the door is to be opened) and the above-described up-and-down movement of the handle lever 9 (when the door is to be opened) are not regulated.

Figure 10:
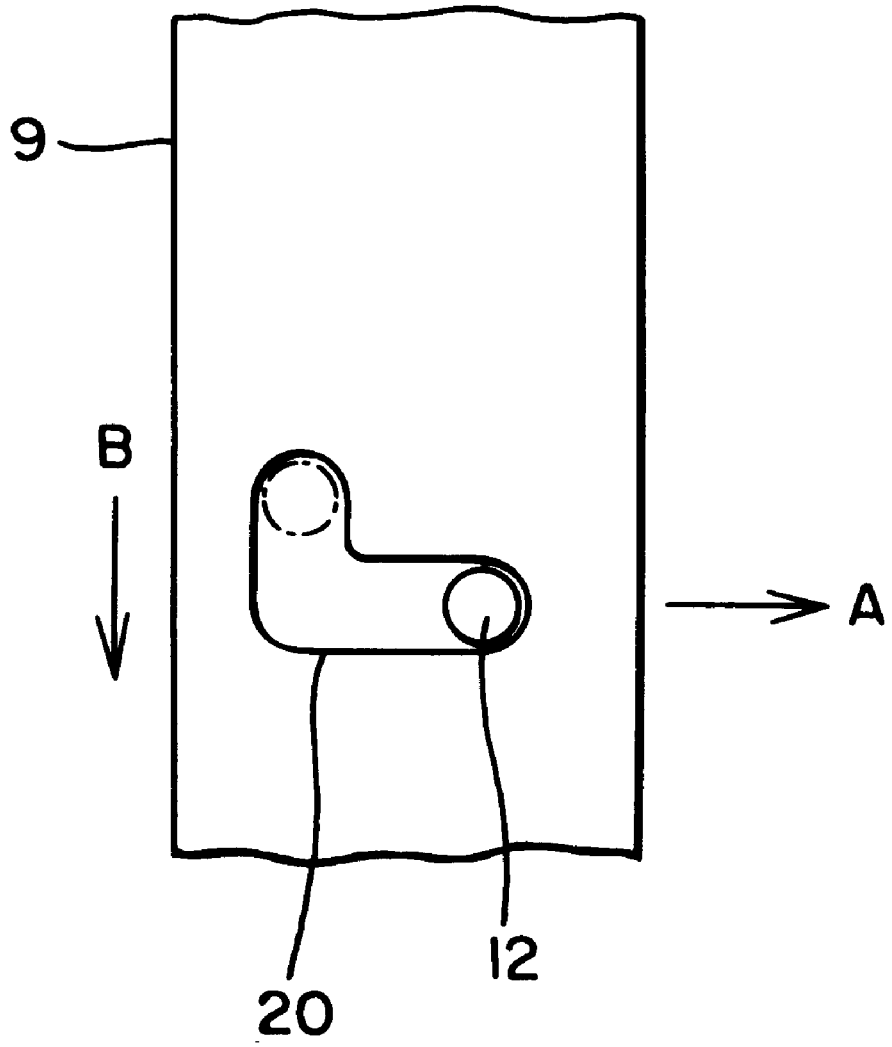
FIG. 10 illustrates a modification in which a handle lever is provided with an L-shaped groove instead of a step portion.

In a modification of the invention, the handle lever 9 is provided with an L-shaped groove 20 and the pin 12 is passed through the groove. The pin 12 is positioned at a place indicated by a solid line in FIG. 10 when it is in a normal state. When the handle lever 9 descends in the B direction owing to the normal door opening operation of pulling the outside handle 5, the pin 12 abuts against the horizontal portion of the groove 20 and descends along with the handle lever 9, thereby operating the opening lever 18. Under application of an unexpected transverse load that is greater than a predetermined value, the handle lever 9 is moved in the direction of arrow A in FIG. 10 so that the pin 12 becomes situated at the left end of the horizontal portion of groove 20. Even though the outside handle 5 being acted upon by the transverse load is forcibly pulled out so that the handle lever 9 is pushed down via the arm 6', the pin 12 merely undergoes relative movement within the vertical portion of the groove 20 and does not operate the opening lever. The action of these components is the same as that described and illustrated above in connection with FIGS. 6 through 9.

As many apparently widely different embodiments of the present invention can be made without departing from the spirit and scope thereof, it is to be understood that the invention is not limited to the specific embodiments thereof except as defined in the appended claims.

What is claimed is:

1. An outside door handle assembly for a door of an automotive vehicle having a door lock device which includes an opening lever, comprising:

a handle case for being secured to the door of the automotive vehicle;

an outside handle freely rotatably supported on said handle case and linked to the opening lever of said door lock device, which is for holding the door closed, said outside handle turning to cause the opening lever to unlock the door lock device; and a handle lever freely rotatably supported on the outside handle for being swung transversely outwardly of the vehicle in response to being acted upon by a transverse load in the transverse direction of the vehicle;

wherein when a transverse load acts upon the vehicle, turning of said outside handle is limited by transverse swinging of said handle lever outwardly of the vehicle with respect to the handle case owing to the transverse load.

2. The assembly according to claim 1, wherein said handle lever has a hook face and said handle case has a stopper portion;

transverse swinging of said handle lever outwardly of the vehicle causing said hook face to freely engage said stopper portion.

3. The assembly according to claim 1, wherein said handle lever is engaged with said opening lever at all times and transverse swinging of said handle lever outwardly of the vehicle causes said handle lever be displaced from a path of engagement with said opening lever, whereby said handle lever is rendered free to disengage from said opening lever.

4. An outside door handle for an automotive vehicle having a door lock device which includes an opening lever, comprising:

a handle case secured to the door of the automotive vehicle;

an outside handle freely rotatably supported on said handle case and linked to the opening lever of said door lock device, which is for holding the door closed, said turning of said outside handle being for opening the door by causing the opening lever to turn; and a pair of spaced frames formed on said handle case;

a shaft extending between said frames;

first and second arms formed on said outside handle and freely rotatably supported on said shaft;

a handle lever freely swingably supported on said first arm and capable of swinging in a first direction in response to being acted upon by a transverse load in the transverse direction of the vehicle;

a spring provided between said first arm and said handle case for swingingly biasing said first arm in a second direction opposed to the first direction;

a rod connecting said second arm to said opening lever; and a stopper secured to said handle case for engaging said handle lever owing to swinging of said handle lever in the first direction.

5. An outside door handle for an automotive vehicle, comprising:

a handle case secured to a door of an automotive vehicle having a door lock device which includes an opening lever;

an outside handle freely rotatably supported on said handle case and linked to an opening lever of a door lock device, which is for holding the door closed;

turning of said outside handle opening the door by causing the opening lever to turn; and a pair of spaced frames formed on said handle case;

a shaft extending between said frames;

first and second arms formed on said outside handle and freely rotatably supported on said shaft;

a handle lever freely swingably supported on said first arm and engageable with said opening lever along a path of engagement, said handle lever being swung in a first direction, in response to being acted upon by a transverse load in the transverse direction of the vehicle, so as to leave the path of engagement with said opening lever; and a spring provided between said first arm and said handle lever for swingingly biasing said first arm in a second direction.

6. An outside door handle assembly for a door of an automotive vehicle having a door lock device which includes an opening lever, comprising:

a handle case secured to a stationary member on a side of a door of an automotive vehicle;

a pair of spaced frames formed as an integral part of said handle case;

a shaft extending between said frames;

an outside handle freely rotatably supported on said shaft via first and second arms and linked to said opening lever;

a first spring having a first end engaged with said first arm and a second end engaged with said handle case for biasing said outside handle in a first direction; and a handle lever freely rotatably supported on said first arm or said second arm via a second spring;

wherein when a transverse load acts upon the vehicle, said handle lever swings transversely outwardly of the vehicle with respect to the handle case so that turning of the outside handle is limited.

7. The assembly according to claim 6, wherein said handle lever has a stepped portion engageable with a pin secured to an opening lever of said door lock device and is rotated around a center of said shaft to disengage the said pin from said stepped portion when the traverse load is applied.

8. The assembly according to claim 6, wherein a pivot point of the handle lever is located above an axis of the shaft.

* * * * *